United States Patent [19]

Myers

[11] 4,306,206

[45] Dec. 15, 1981

[54] LINEAR SOLENOID DEVICE

[75] Inventor: John L. Myers, Tipp City, Ohio

[73] Assignee: Ledex, Inc., Vandalia, Ohio

[21] Appl. No.: 157,912

[22] Filed: Jun. 9, 1980

[51] Int. Cl.[3] ..... H01F 7/08

[52] U.S. Cl. ..... 335/230; 335/229; 335/234

[58] Field of Search ..... 335/229, 230, 231, 232, 335/233, 234, 235, 236

[56] References Cited

U.S. PATENT DOCUMENTS

| | | | |
|---|---|---|---|
| 3,504,315 | 3/1970 | Stanwell | 335/234 |
| 3,728,654 | 4/1973 | Tada | 335/234 |
| 3,783,423 | 1/1974 | Mater et al. | 335/229 |
| 4,157,520 | 6/1979 | Moates et al. | 335/230 |

*Primary Examiner*—Harold Broome

*Attorney, Agent, or Firm*—Biebel, French & Nauman

[57] ABSTRACT

A linear solenoid device includes a stator defining a cylindrical stator opening, and a pair of axially spaced cylindrical stator pole surfaces. An armature is mounted within the stator opening for movement parallel to the stator pole surfaces. The armature defines a pair of armature pole surfaces which overlap the stator pole surfaces by varying areas as the armature is moved. Annular air gaps are defined between the stator pole surfaces and the armature and the armature has mounted thereon a pair of cylindrical radially polarized permanent magnets, each such magnet being adjacent one of the armature pole surfaces. When a stator coil is energized, movement of the armature results from the varying reluctance across the air gaps as the armature pole surfaces overlap varying areas of the stator pole surfaces and, also, from repulsion of the permanent magnets. As a consequence, higher force outputs are attainable.

14 Claims, 4 Drawing Figures

LINEAR SOLENOID DEVICE

BACKGROUND OF THE INVENTION

The present invention relates to linear solenoid devices and, more particularly, to such a device in which the movable solenoid armature carries a plurality of permanent magnets which enable the device to provide a substantially higher force output than heretofore attainable.

A number of solenoid actuators in the past has incorporated permanent magnets, although such magnets have generally been configured and positioned within the solenoid devices to provide either detent or bidirectional capability. Devices in which one or more permanent magnets are incorporated within the stator structure of the solenoid device to hold the solenoid armature in one or more detent positions are disclosed in U.S. Pat. No. 4,072,918, issued Feb. 7, 1978, to Read; U.S. Pat. No. 3,886,507, issued May 27, 1975, to Johnston et al; U.S. Pat. No. 3,828,288, issued Aug. 6, 1974, to Boyd; U.S. Pat. No. 3,728,654, issued Apr. 17, 1973, to Tada; and U.S. Pat. No. 3,460,081, issued Aug. 5, 1969, to Tillman. Typically, the stator permanent magnet or magnets in such a device hold the armature in a detent position at one or both limits of armature movement with the actual movement of the armature to the detent positions being accomplished in a conventional manner. The magnets do not affect the force output of the solenoid device produced as the armature is moved toward the detent position or positions.

A number of other prior art patents disclose bidirectional solenoids in which the solenoid armature carries one or more permanent magnets, with the magnets on the armature being attracted or repelled to move the armature as desired in dependence upon the polarity of the current supplied to the stator coil of the device. This group of patents includes U.S. Pat. No. 4,065,739, issued Dec. 27, 1977, to Jaffe et al; U.S. Pat. No. 4,129,187, issued December 12, 1978, to Wengryn et al; U.S. Pat. No. 3,775,714, issued November 27, 1973, to Heuer; U.S. Pat. No. 3,914,723, issued Oct. 21, 1975, to Goodbar; U.S. Pat. No. 4,195,277, issued Mar. 25, 1980, to Leicht; and U.S. Pat. No. 3,202,886, issued Aug. 24, 1965, to Kramer. The Wengryn et al patent also incorporates a permanent magnet in the stator structure for repelling the armature in a first direction with movement of the armature in the opposite direction being provided as a result of energization of a stator coil which provides an opposing flux flow. The Jaffe et al patent discloses an armature arrangement in which the permanent magnet on the armature is radially polarized. Since the stator coil provides generally axial flux flow through the armature, apparently the lateral force of the armature results from nonuniformity of the flux density in the armature produced by energization of the stator coil. The Leicht patent discloses a device having a permanent magnet armature polarized in a direction normal to the direction of armature movement with a pair of oppositely polarized stator poles to effect simultaneous repulsion and attraction of the armature magnet.

U.S. Pat. No. 4,127,835, issued Nov. 28, 1978, to Knutson discloses a bidirectional solenoid device in which permanent magnets are mounted adjacent end plates at each end of the stator with a stator coil therebetween. The permanent magnets are oppositely polarized such that when the stator coil is energized, the flux produced by the coil adds to the flux produced by one of the magnets, while subtracting from or opposing the flux produced by the other of the magnets. Thus, one end of the armature is attracted more strongly toward its associated end plate than the other end of the armature.

U.S. Pat. No. 3,504,320, issued Mar. 31, 1970, to Engdahl et al, discloses a linearly acting current force transducer device having a pair of oppositely polarized permanent magnets mounted on the movable armature structure and including three separate serially connected stator coils. This arrangement is said to produce a high degree of linearity between the input current and the force output of the device.

Permanent magnets have also been incorporated into the rotor structure of rotary solenoid devices. Specifically, a variable reluctance rotary solenoid device including a pair of permanent magnets mounted on the rotor is disclosed in U.S. Pat. No. 4,135,138, issued Jan. 16, 1979, to McClintock. In the McClintock device, the rotor permanent magnets are repelled from the stator poles, as adjacent rotor pole surfaces are attracted toward the stator poles. McClintock, however, does not suggest utilizing such an arrangement in a linear solenoid device. Other rotary electromagnetic devices have incorporated a permanent magnet into the rotor structure, which magnet is simply attracted to one or more pole surfaces of a stator. Such devices are shown in U.S. Pat. No. 3,636,557, issued Jan. 18, 1972, to Watkins; U.S. Pat. No. 3,694,782, issued Sept. 26, 1972, to Ray; and U.S. Pat. No. 3,311,859, issued Mar. 28, 1967, to Bieger et al.

It is seen, therefore, that there is a need for a linear solenoid device which provides a substantially increased force output and which incorporates one or more permanent magnets into its armature.

SUMMARY OF THE INVENTION

A linear solenoid includes a stator means having a stator casing. The stator casing defines a cylindrical stator opening within a pair of parallel axially spaced, cylindrical stator pole surfaces. The stator casing further defines a flux carrying path between the stator pole surfaces. An armature means is slidably mounted within the stator opening for movement parallel to the stator pole surfaces. The armature means includes a pair of parallel axially spaced, cylindrical armature pole surfaces and a corresponding pair of cylindrical radially magnetized permanent magnets. Each permanent magnet is adjacent and axially displaced from an associated one of the pair of armature pole surfaces. The armature means further defines a flux carrying path between the armature pole surfaces, whereby a pair of axially displaced annular air gaps are defined between the armature means and the stator means. A coil means is provided for producing electromagnet flux flow through the stator casing and through the armature means when an electrical current is supplied to the coil means. The flux flow produced by the coil means extends across the annular air gaps in a direction substantially radially with respect thereto to cause the stator means to move parallel to the stator pole surfaces.

One of the permanent magnets may be polarized to produce flux flow radially outward across one of the air gaps and the other of the permanent magnets may be polarized to produce flux flow radially inward across the other of the air gaps, thereby producing flux flow in a first direction through the armature means and the stator means. The coil means produces flux flow in a second direction, opposite to the first direction, through the armature means and the stator means.

The armature means may further include a pair of cylindrical rings of nonflux carrying material, with each of the rings being mounted on the armature means adjacent a respective one of the permanent magnets.

The cylindrical radially magnetized permanent magnets are spaced apart axially on the armature means by a distance corresponding to the axial spacing between the stator pole surfaces, whereby flux produced by the permanent magnets tends to move the armature means when an electrical current is not supplied to the coil means such that the permanent magnets are aligned with the stator pole surfaces.

Accordingly, it is an object of the present invention to provide a linear solenoid device including a stator having a coil producing an electromagnetic flux flow through the stator, and an armature having a pair of permanent magnets such that flux flow produced by the stator coil opposes the flux flow produced by the permanent magnets to provide movement of the armature; to provide such a device in which the stator defines axially spaced stator pole surfaces and in which the armature defines corresponding axially spaced armature pole surfaces; to provide such a device in which each of the permanent magnets defines a permanent magnet ring which is radially polarized; and to provide such a device in which one of the permanent magnet rings is polarized radially inward while the other of the permanent magnets is radially polarized outward.

Other objects and advantages of the invention will be apparent from the following description, the accompanying drawings and the appended claims.

DETAILED DESCRIPTION OF THE PREFERRED EMBODIMENT

Figure 1:
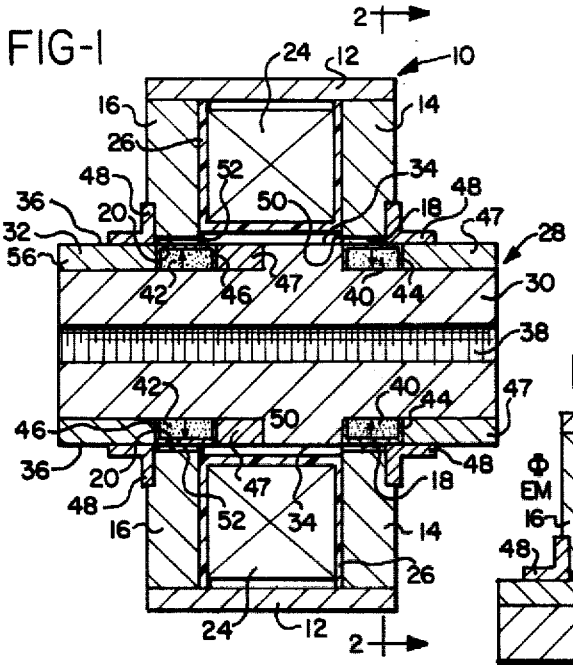
FIG. 1 is a sectional view of a linear solenoid device embodying the present invention, taken through the central axis thereof.
Figure 2:
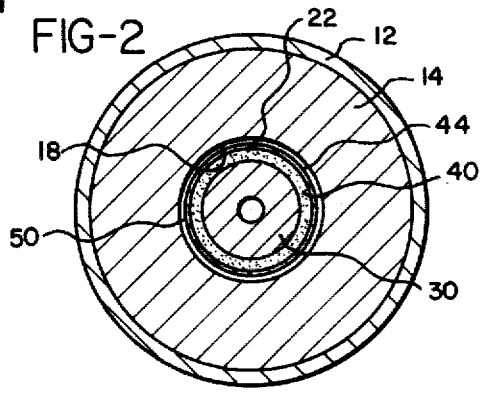
FIG. 2 is a sectional view, taken generally along line 2—2 in FIG. 1.

Reference is made to FIGS. 1 and 2 of the drawings which illustrate a linear solenoid device constructed according to the present invention. The device includes a stator means 10 including a stator casing consisting of a cylindrical portion 12 and a pair of end portions 14 and 16. One of the end portions 14 and 16 is mounted at each end of the cylindrical portion 12, with the end portions 14 and 16 extending radially inward to define a pair of aligned, axially spaced cylindrical stator pole surfaces 18 and 20. Cylindrical portion 12 and end portions 14 and 16 are made of a flux carrying material, such as a low carbon steel. Thus, the casing 10 defines a flux carrying path between the stator pole surfaces 18 and 20. Stator casing 10 further defines a casing opening 22 therein.

An electromagnetic coil means including a plurality of windings 24 of insulated copper wire wound upon nonmagnetic coil bobbin 26 is disposed within the cylindrical portion 12 and between the end portions 14 of the casing 10 for producing a flux flow through the flux carrying path defined by the stator casing upon the application of an electrical current to the windings 24. Winding connector leads (not shown) extend through an opening (not shown) in the casing 10 to provide a means for supplying such electrical current to the windings 24.

An armature means 28 is slidably mounted within the stator opening 22 for movement parallel to the stator pole surfaces 18 and 20. The armature means includes an armature assembly having an armature core 30 and core ring 32. Core 30 and ring 32 are made of a flux carrying material, such as a low carbon steel, and define a pair of cylindrical armature pole surfaces 34 and 36. Core 30 further defines a central threaded opening 38 which may engage a threaded shaft (not shown) to transfer the force output of the armature 28 to other apparatus used in conjunction with the solenoid device. The core 30 and ring 32 define a flux carrying path between the pair of axially spaced cylindrical armature pole surfaces 34 and 36.

The armature assembly further includes a pair of cylindrical, radially magnetized permanent magnet rings 40 and 42, each such permanent magnet ring being adjacent and axially displaced from an associated one of the pair of armature pole surfaces 34 and 36. Permanent magnets 40 and 42 are enclosed within magnet holders 44 and 46, respectively. Mounted on the armature core 30 are a pair of cylindrical retainer rings 47 of non-flux carrying material, such as non-magnetic stainless steel.

Brass bearings 48 support the armature 28 within the stator means 10, thereby defining a pair of axially displaced annular air gaps 50 and 52 therebetween. When energized, the coil means produces an electromagnetic flux flow through the stator casing and through the armature means which flux flow extends across the annular air gaps 50 and 52 in a direction substantially radially with respect thereto, to cause the armature to move parallel to the stator pole surfaces 18 and 20.

Figure 3:
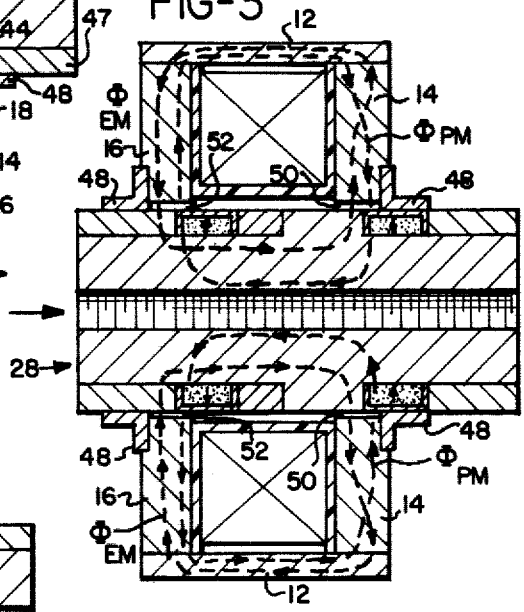
FIG. 3 is a sectional view, similar to FIG. 1, illustrating the flux flow paths when the stator coil is energized and the armature has moved partially to the right.

Permanent magnet 42 is polarized radially to produce flux flow radially outward across air gap 52, while permanent magnet 40 is polarized to produce flux flow radially inward across the air gap 50. When the coil 24 is not energized, the permanent magnets 40 and 42 therefore produce a flux flow across the air gaps 50 and 52 in a first direction through the casing portions 12, 14, and 16 and through the armature core 30. This flux flow resulting from the permanent magnets is indicated schematically as flux flow $\Phi_{PM}$ in FIG. 3. As a consequence, magnets 40 and 42 are attracted to opposing stator pole surfaces 18 and 20, respectively, such that the armature assumes the position illustrated in FIG. 1.

When a current is supplied to the windings of coil 24, a flux flow $\Phi_{EM}$ is produced through the armature 28, the stator casing portions 12, 14, and 16, and across the air gaps 50 and 52. The direction of current flow and the direction of windings in the coil 24 are chosen such that the flux $\Phi_{EM}$ produced by energization of the coil flows through the stator means and the armature means in a direction which is opposite that of the direction of flow of flux $\Phi_{PM}$ produced by the permanent magnets 40 and 42.

As a result, the magnet 40 will tend to be repelled from the opposing stator pole surface 18 and the magnet 42 will tend to be repelled from the opposing stator pole surface 20. Since the rings of nonflux carrying material 47 and 47 are situated to the right of the respective magnets 40 and 42, as seen in FIG. 1, flux flow across the air gaps 50 and 52 will pass into the armature 28 through the magnets and through the corresponding armature pole surfaces 34 and 36. Thus, simultaneously with the repulsion of the permanent magnets from the stator pole surfaces, and the resultant force exerted on the armature 28 to the right, an attraction between the armature pole surfaces 34 and 36 and the stator pole surfaces 18 and 20, respectively, will occur, also producing a movement of the armature 28 to the right.

Figure 4:
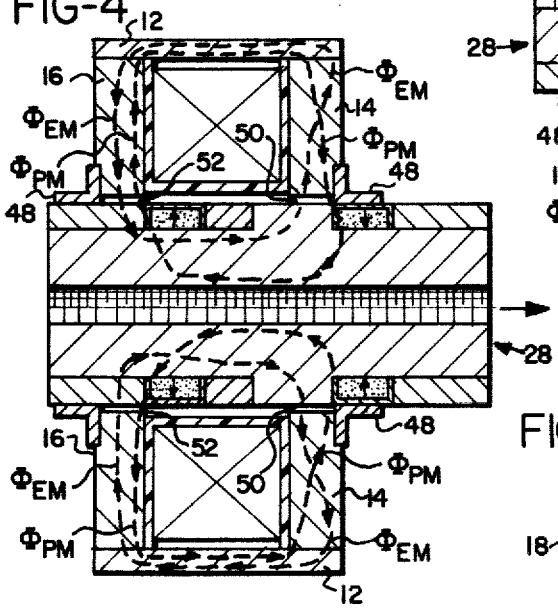
FIG. 4 is a sectional view, similar to FIG. 1, showing the armature at the rightmost limit of travel.

This can be characterized as a variable reluctance phenomenon in that the reluctance of the air gaps 50 and 52 is reduced by movement to the right of the armature 28 and the resulting increase in overlap between the stator pole surfaces and the respective armature pole surfaces. The armature 28 will thus be moved through the intermediate position illustrated in FIG. 3 toward the final armature position illustrated in FIG. 4.

The force output obtainable with the solenoid device of the present invention is substantially greater than that which would be obtained with a similar device in which the permanent magnets were omitted. This is because the force output results from repulsion of the permanent magnets and also from the variation in reluctance of the overlapping pole surfaces as the armature is moved. The solenoid device of the present invention may also be viewed as providing an increased force as a result of a substantially greater variation in flux obtainable through the stator and armature than would be the case without the permanent magnets. If flux flow in the direction produced by the electromagnetic coil 24 is considered to be positive flux flow, initially a negative flux flow is produced by the permanent magnets with the coil 24 deenergized. As the current supplied to the coil 24 is increased, however, the negative flux flow is gradually reduced until the flux produced by the electromagnetic coil 24 exceeds that produced by the permanent magnets. At this point, the net flux flow becomes positive and is thereafter increased to some maximum value, which value is limited by the flux saturation level of the flux flow paths through the stator and armature. As a consequence, the flux range over which the device is capable of operating without saturation is substantially increased and the maximum force output of the device is correspondingly increased.

It will be appreciated that it may be desirable to embody the present invention in a linear solenoid device having only a single permanent magnet adjacent only one of the armature pole surfaces. In such an arrangement movement of the armature results from the combined effects of the overlapping pairs of stator and armature pole surfaces, as well as from repulsion of the single permanent magnet. It would also be possible to construct a device according to the present invention in which only a single permanent magnet and a single stator pole surface/armature pole surface pair is utilized, with an additional non-working air gap being provided between the armature and stator to provide a flux return path therebetween.

It will be understood that the term "linear" has been utilized in the specification and claims to refer to a device having straight line armature movement, as distinguished from a rotary solenoid device.

While the form of apparatus herein described constitutes a preferred embodiment of the invention, it is to be understood that the invention is not limited to this precise form of apparatus, and that changes may be made therein without departing from the scope of the invention.

What is claimed is:

1. A linear solenoid, comprising:

stator means including a stator casing defining a cylindrical stator opening within a pair of axially-spaced, cylindrical stator pole surfaces, and further defining a flux carrying path between said stator pole surfaces, armature means, mounted within said stator opening for movement parallel to said stator pole surfaces, including a pair of axially-spaced, cylindrical armature pole surfaces and a corresponding pair of cylindrical radially magnetized permanent magnets; each such permanent magnet being adjacent and axially displaced from an associated one of said pair of armature pole surfaces, said armature means further defining a flux carrying path between said armature pole surfaces, whereby a pair of axially displaced annular air gaps are defined between said armature means and said stator means, and coil means for producing electromagnetic flux flow through said stator casing and through said armature means when an electrical current is supplied to said coil means, which flux flow extends across said annular air gaps in a direction substantially radially with respect thereto, to cause said armature means to move parallel to said stator pole surfaces.

2. The linear solenoid of claim 1 in which one of said permanent magnets is polarized to produce flux flow radially outward across one of said air gaps and the other of said permanent magnets is polarized to produce flux flow radially inward across the other of said air gaps, thereby producing flux flow in a first direction through said armature means and said stator means.

3. The linear solenoid of claim 2 in which said coil means produces flux flow in a second direction, opposite to said first direction, through said armature means and said stator means.

4. The linear solenoid of claim 1 in which said armature means further comprises a pair of cylindrical rings of non-flux carrying material, each of said rings being mounted on said armature means adjacent a respective one of said permanent magnets.

5. The linear actuator of claim 1 in which said cylindrical radially magnetized permanent magnets are spaced apart axially on said armature means by a distance corresponding to the axial spacing between said stator pole surfaces, whereby flux produced by said permanent magnets tends to move said armature means such that said permanent magnets are aligned with said stator pole surfaces when an electrical current is not supplied to said coil means.

6. A linear solenoid device, comprising:

a solenoid stator defining a pair of parallel stator pole surfaces and a flux carrying path therebetween, said stator further including a stator coil which, when electrically energized, produces flux flow through said flux carrying path between said stator pole surfaces, a solenoid armature including a pair of parallel armature pole surfaces and defining a flux carrying path therebetween, said armature further including a pair of permanent magnets, each of said permanent magnets being mounted adjacent a respective one of said pair of armature pole surfaces, the spacing between said pair of permanent magnets corresponding to the spacing between said stator pole surfaces, and means mounting said armature adjacent said stator, and defining air gaps between said stator pole surfaces and said armature, for linear movement of said armature in a direction parallel to said stator pole surfaces when said coil produces a flux flow through said stator and said armature and across the air gaps therebetween.

7. The linear solenoid device of claim 6 in which said permanent magnets produce a flux flow through said stator, said armature and across said air gaps in a first direction and in which said stator coil, when energized, produces a flux flow through said stator, said armature and across said air gaps in a second direction, opposite to said first direction.

8. A linear solenoid device, comprisng:

a stator casing including a cylindrical portion and a pair of end portions, one of said end portions being mounted at each end of said cylindrical portion, said end portions extending radially inward to define a pair of aligned, axially-spaced cylindrical stator pole surfaces, said cylindrical portion and said end portions defining a flux carrying path between said stator pole surfaces and defining a cylindrical casing opening within said stator pole surfaces, electromagnetic coil means, disposed within said cylindrical portion and between said end portions, for producing flux flow through said flux carrying path, a substantially cylindrical armature assembly, including an armature core of flux carrying material and defining a pair of cylindrical armature pole surfaces, a pair of radially polarized permanent magnet rings axially displaced on said core by a distance corresponding to the axial displacement between said end portions of said casing, each of said permanent magnet rings being adjacent and axially displaced from a respective one of said pair of armature pole surfaces, a pair of nonflux carrying rings, each of said non-flux carrying rings being mounted on said core adjacent a respective one of said permanent magnet rings and positioned on the opposite side of the adjacent permanent magnet ring from the respective one of said armature pole surfaces, and bearing means for mounting said armature assembly within said casing opening such that said armature assembly may move axially in response to energization of said coil means.

9. The linear solenoid device of claim 8 in which said permanent magnet rings are radially polarized in opposite directions so as to produce flux flow through said stator means and armature means in a direction opposite to the direction of flux flow produced by said coil means.

10. A linear solenoid, comprising:

stator means including a stator casing defining a cylindrical stator opening within at least one cylindrical stator pole surface, and further defining a flux carrying path through said stator casing to said stator pole surface, cylindrical armature means, mounted within said stator opening for axial movement parallel to said stator pole surface, including at least one cylindrical armature pole surface and a cylindrical radially magnetized permanent magnet mounted adjacent and axially displaced from said armature pole surface, said armature means further defining a flux carrying path therethrough to said armature pole surface, whereby an annular air gap is defined between said armature means and said stator means, and coil means for producing electromagnetic flux flow through said stator casing and through said armature means when an electrical current is supplied to said coil means, which flux flow extends across said annular air gap in a direction substantially radially with respect thereto, to cause said armature means to move parallel to said stator pole surface.

11. The linear solenoid of claim 10 in which said permanent magnet is polarized to produce flux flow radially across said air gap in a first direction through said armature means and said stator means and in which said coil means produces flux flow in a second direction, opposite to said first direction, across said air gap through said armature means and said stator means.

12. The linear solenoid of claim 10 in which said armature means further comprises a cylindrical ring of non-flux carrying material, said ring being mounted on said armature means adjacent said permanent magnet.

13. A linear solenoid device, comprising:

a solenoid stator defining a stator pole surface and a flux carrying path through said stator to said stator pole surface, said stator further including a stator coil which, when electrically energized, produces flux flow through said flux carrying path, a solenoid armature including an armature pole surface and defining a flux carrying path therethrough to said armature pole surface, said armature further including permanent magnets mounted adjacent said armature pole surface, and means mounting said armature adjacent said stator such that said armature pole surface and said stator pole surface are substantially parallel, and defining an air gap between said stator pole surface and said armature, for linear movement of said armature in a direction parallel to said stator pole surface when said coil produces a flux flow through said stator and said armature and across the air gap therebetween.

14. The linear solenoid device of claim 13 in which said permanent magnet produces a flux flow through said stator, said armature and across said air gap in a first direction and in which said stator coil, when energized, produces a first flow through said stator, said armature and across said air gap in a second direction, opposite to said first direction.

* * * * *